United States Patent [19]

Chatigny

[11] 3,988,848

[45] Nov. 2, 1976

[54] SAFETY DEVICE FOR FIREARMS

[75] Inventor: Raymond E. Chatigny, Westminster, Mass.

[73] Assignee: Harrington & Richardson, Inc., Gardner, Mass.

[22] Filed: Sept. 16, 1974

[21] Appl. No.: 506,169

[52] U.S. Cl. ..... 42/70 F; 42/66
[51] Int. Cl.[2] ..... F41C 17/00
[58] Field of Search ..... 42/70 F, 66

[56] References Cited

UNITED STATES PATENTS

| | | | |
|---|---|---|---|
| 566,393 | 8/1896 | Fyrberg | 42/66 |
| 600,337 | 3/1898 | Richardson | 42/66 |
| 609,233 | 8/1898 | Houghton | 42/66 |
| 875,469 | 12/1907 | Tambour | 42/70 F |
| 933,188 | 9/1909 | Leggett | 42/66 |
| 3,086,310 | 4/1963 | Katz | 42/70 F |
| 3,701,213 | 10/1972 | Lewis | 42/66 |

*Primary Examiner*—Charles T. Jordan
*Attorney, Agent, or Firm*—Charles R. Fay

[57] ABSTRACT

A firearm having a hammer, firing pin, and trigger, and a movable firing block interposed between the firing pin and the hammer to actuate the firing pin when the hammer falls on it. The firing block is held in position by the trigger only when pressed, and the hammer fails to contact the firing block should it accidentally fall without the trigger being pressed.

The hammer upon being cocked pushes the firing block up into firing position. When the trigger is pulled, a firing block stop moves forwardly and prevents the firing block from dropping. The means on the hammer that pushed the firing block up is biassed to retract when the hammer falls, so that the firing action is completely dependent on the trigger.

5 Claims, 3 Drawing Figures

SAFETY DEVICE FOR FIREARMS

BACKGROUND OF THE INVENTION

There have been many safety devices suggested in the past so that if a hammer should accidentally fall without however the trigger having been pressed the firearm will not fire. However, such mechanisms are unsatisfactory in some respects and there is usually some other device which must have to be manually actuated in order to activate the safety device, and obviously when the shooter neglects to actuate the second device then the gun is not safe. It is the object of the present invention to provide a simple mechanism which is ready to fire upon the hammer being cocked but in which no firing will take place unless the trigger is pulled or pressed so that the firing is completely under the control of the trigger.

In the present case the structure is such that the action is completely automatic and the operator need do nothing whatsoever because the safety device is at all times in condition to operate.

SUMMARY OF THE INVENTION

A firing pin is positioned in more or less the usual manner but the hammer is provided with a recess so that when the hammer falls the end of the firing pin will be in the recess and the firearm will not be fired. There is a firing block however which is raised from a lowered position, against the action of a spring, by means on the hammer when the hammer is moved to the cocked position. The firing block is pivotally mounted on a lever which has a shoulder, and on the trigger there is mounted a firing block barrier or stop which engages the shoulder on the lever and holds the firing block in the firing position.

When the hammer falls the firing block and its lever are biassed downwardly out of the firing position in the absence of being held in the firing position by said barrier or stop. The stop is mounted on the trigger and moves therewith, but when the trigger is pulled and only when the trigger is pulled, does the stop extend to a position under the shoulder on the firing block lever, thereby holding the firing block in position and causing the gun to fire through transmission of pressure from the bottom of the recess on the hammer to the firing pin.

If however for any reason the hammer falls but the trigger is not pressed the barrier or stop will not be placed under the shoulder to maintain the firing block in the firing position, and the means on the hammer which raised the firing block into the firing position retreats from the lever and allows it to descend, so that the firing block is retracted out of firing position.

PREFERRED EMBODIMENT OF THE INVENTION

Figure 1:
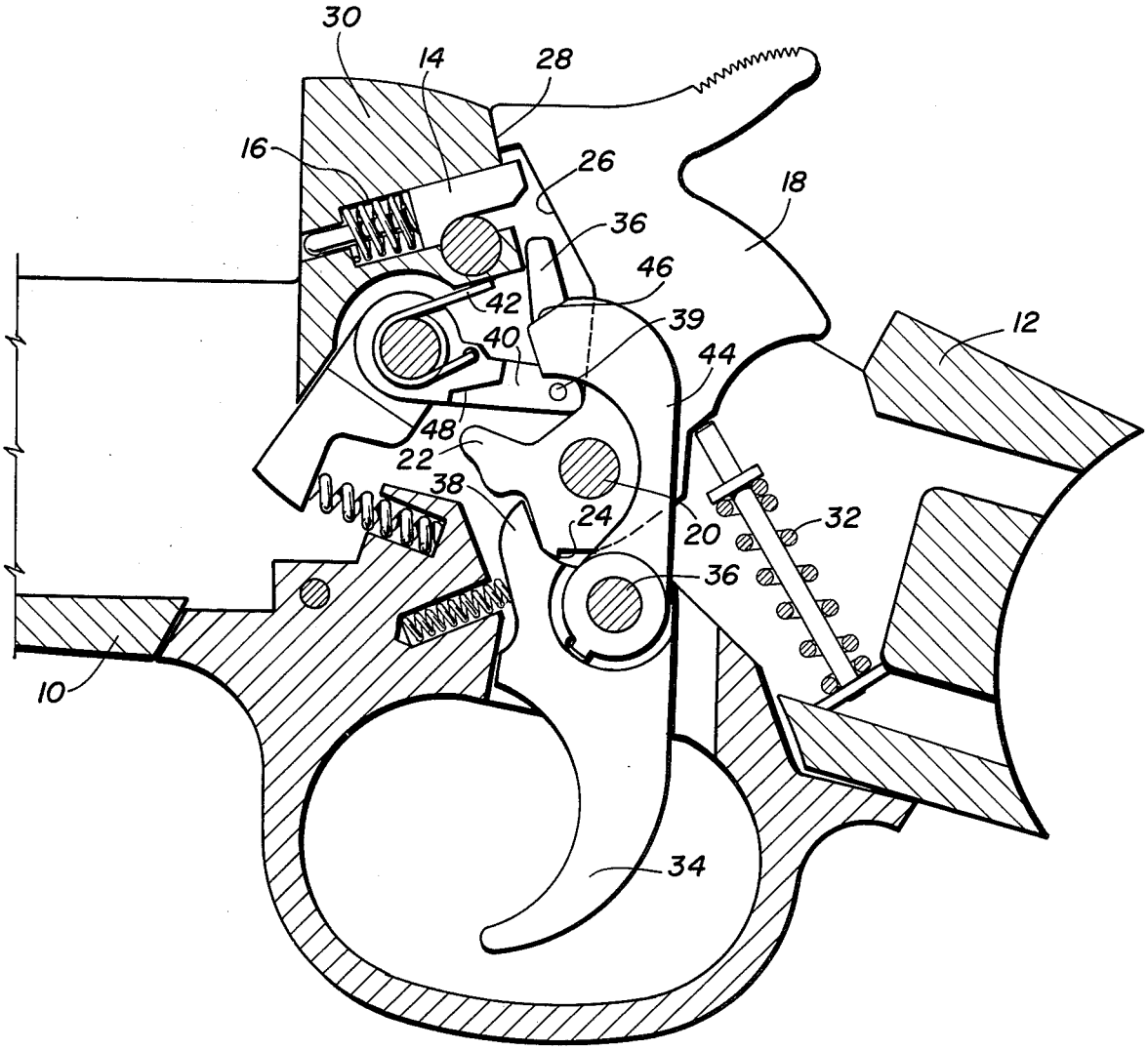
FIG. 1 is a view illustrating the parts the in normal condition prior to cocking the hammer.

Referring now to FIG. 1 the firearm ignition is shown in its normal position, the hammer not being cocked. This invention has been shown in this case as associated with the receiver of a shotgun or exposed hammer of a rifle or the like but the invention is applicable to any firearm having a hammer.

The frame of the receiver is indicated at 10 and no barrel is shown for purposes of clarity of illustration. The frame 12 is a part of the receiver and there is a firing pin 14 located in a cylindrical chamber 16, the firing pin being more or less as usual and spring biassed to the position shown in FIG. 1.

The hammer is generally indicated at 18 being mounted on a pin 20. It has a forward projection 22 and a notch 24. At its forward or firing face it is provided with a recess 26 leaving a forwardly extending portion 28 which strikes the rear surface of the block 30 housing the firing pin 14. It is seen that with the construction thus far described the hammer cannot possibly engage the firing pin in order to provide the ignition. The hammer has the usual hammer spring 32 etc.

Figure 2:
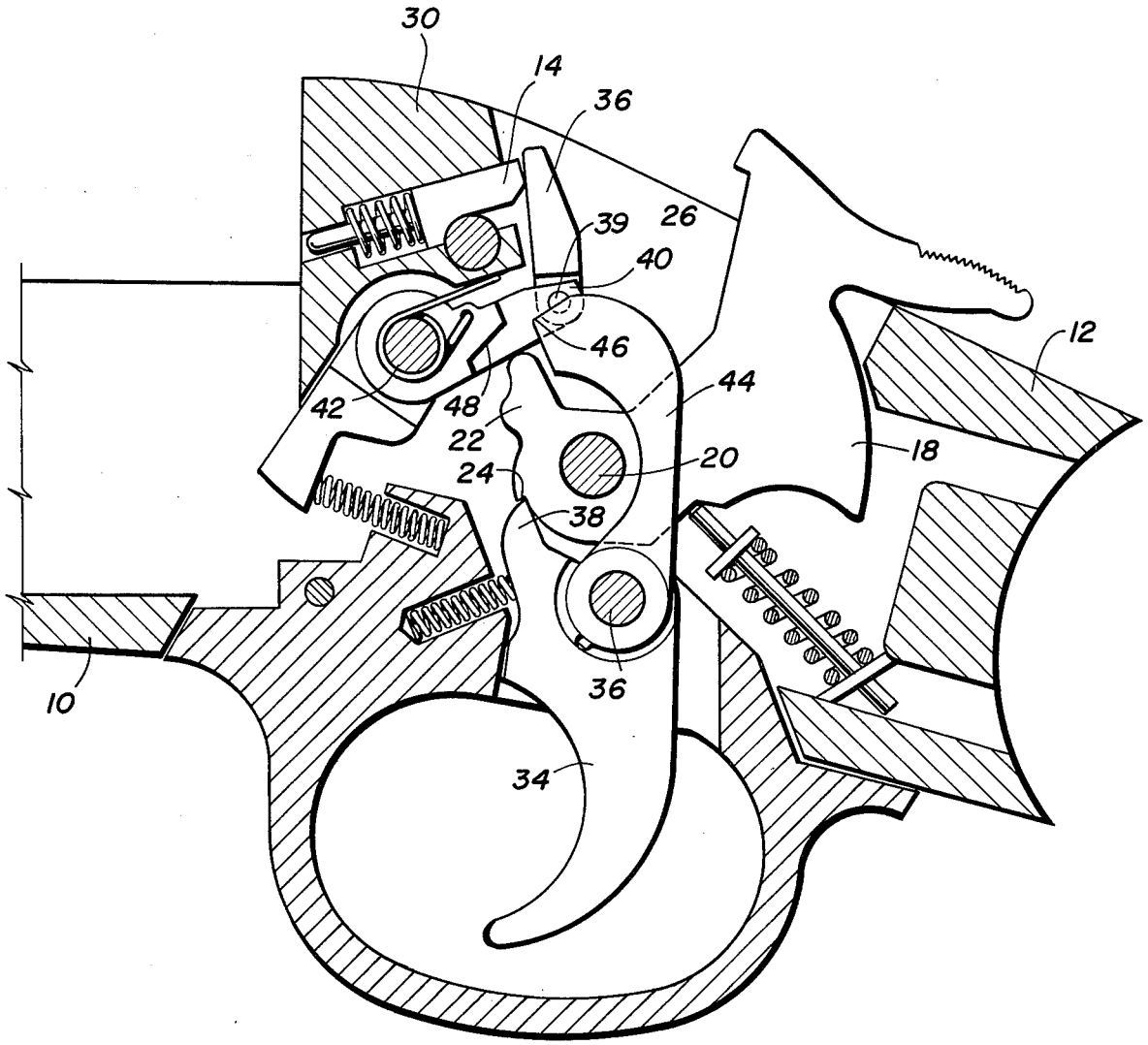
FIG. 2 is a similar view showing the hammer cocked.

The trigger 34 is mounted on a trigger pin 36 and is provided with a nose 38 which acts as a sear to be lodged in the notch 24 in the hammer to maintain the hammer cocked as shown in FIG. 2. There is a firing block 36 pivotally mounted at 39 at the end of a lever 40, the lever 40 being engageable by the hammer projection 22 to be moved in a counterclockwise direction against the action of the biassing spring 42, thereby raising the firing block 36 from its inoperative lower position in FIG. 1 to an operative position as shown in FIG. 2 wherein the firing block overlays the projecting end of firing pin 14 and in alignment with recess 26 in the hammer. Should the hammer fall in this condition the firing pin will be actuated by the bottom of the recess 26 in the hammer impinging upon the rear surface of the firing block 36 which will transmit the pressure to the firing pin and fire the gun.

Figure 3:
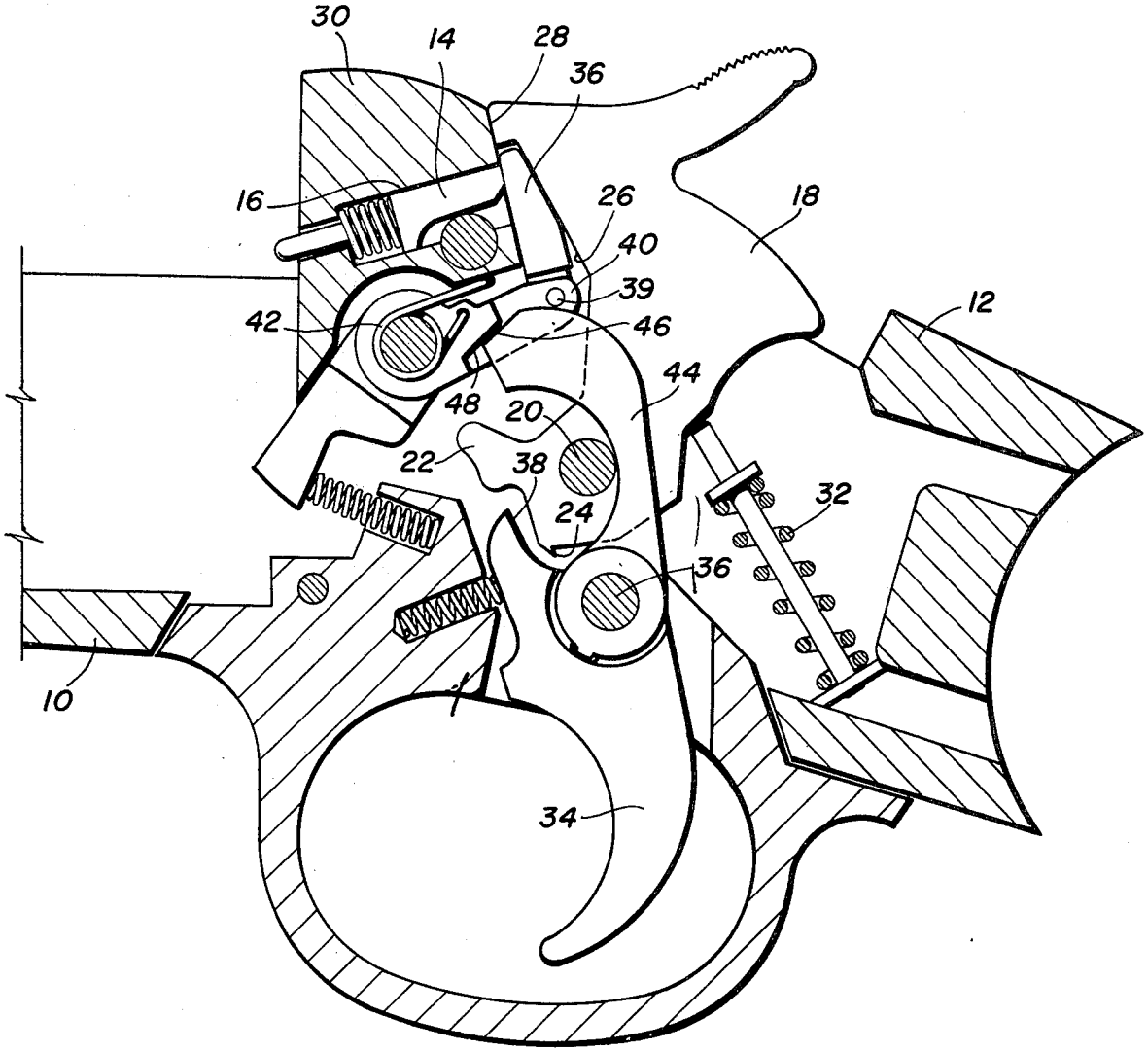
FIG. 3 is a view illustrating the fired position i.e., the hammer has fallen and engaged the firing block upon pressure being exerted on the trigger.

However, of course, it is apparent that if the hammer should fall from its cocked position of FIG. 2 to the fired position of FIG. 3, the firing block 36 will be biassed downwardly out of the way to the FIG. 1 position during the fall of the hammer so that the firing pin will not be struck, unless something prevents the firing block from falling.

The prevention device is the firing block stop or barrier 44 which is mounted on the trigger to move therewith. It is provided with a flat surface at 46 and it will be seen that in the FIG. 2 position the barrier stop is not in position to prevent the fall of the firing block, so that unless the stop or barrier 44 is moved forwardly for instance to the position shown in FIG. 3, to engage shoulder 48 on lever 40, where it will stop the firing block from descending, the gun will not be able to fire at all. The only thing that can move the barrier or stop into the blocking position which is shown in FIG. 3, is pressure on the trigger when the intent is to fire the gun. When the trigger is so pressed, then the firing block is maintained in firing position and the ignition will take place; but if the hammer should fall without the trigger being pulled then the gun will not fire.

After firing, and after the trigger is released, the firing block drops to the position in FIG. 1.

I claim:

1. A safety device for a firearm having a hammer, trigger, and firing pin, including a recess on the hammer causing the same normally to avoid contact with the firing pin, a movable firing block, said firing block comprising means for transmitting pressure from the hammer to the firing pin to actuate the latter, said firing block being movable with respect to the firing pin between an inoperative position and an operative position for firing, means on the hammer to move the firing block into the firing position with relation to the firing pin, biassing means normally urging the firing block to the inoperative position, and means associated with the trigger and movable therewith forming a stop to maintain said the firing block in firing position upon motion of the trigger in a firing direction, said firing block being normally in an inoperative position with relation to said firing pin, whereby the firing block is moved to an inoperative position upon the fall of the hammer without pressure on the trigger, a pivoted firing block lever, said firing block being pivotally mounted on the firing block lever, the means to move the firing block on the hammer engaging the lever and moving the firing block to the firing block operative position, a shoulder on said firing block lever, said stop forming means to be located under said shoulder to prevent the biassing action of the biassing means for the firing block.

2. The safety device of claim 1 wherein the means to move the firing block to the operative position is associated with the hammer and moves upon cocking action thereof to move said firing block to the operative position.

3. The safety device of claim 1 wherein the means on the hammer for engaging the firing block lever and moving the firing block to the operative position comprises a fixed projection on the hammer.

4. The safety device of claim 1 wherein the means on the hammer to avoid contact with the firing pin is a recess at the front face of the hammer.

5. The safety device of claim 4 wherein the firing block substantially fills the recess from the firing block to the bottom of the recess when in raised position.

* * * * *